US009277843B2

(12) United States Patent
Mays et al.

(10) Patent No.: US 9,277,843 B2
(45) Date of Patent: Mar. 8, 2016

(54) WET WIPES CONTAINER

(75) Inventors: Richard Shane Mays, Cincinnati, OH (US); Lucio Frias, Madeira, OH (US); Samir M. Aziz, Cincinnati, OH (US); James Matthew Owen, Covington, KY (US); Richard Lawrence Horstman, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 24 days.

(21) Appl. No.: 13/239,711

(22) Filed: Sep. 22, 2011

(65) Prior Publication Data

US 2012/0074142 A1 Mar. 29, 2012

Related U.S. Application Data

(60) Provisional application No. 61/386,206, filed on Sep. 24, 2010.

(51) Int. Cl.

| | |
|---|---|
| ***B65D 51/18*** | (2006.01) |
| ***A47K 10/42*** | (2006.01) |
| ***B65D 43/02*** | (2006.01) |
| ***B65D 43/16*** | (2006.01) |

(Continued)

(52) U.S. Cl.

CPC ..... *A47K 10/421* (2013.01); *B65D 43/0204* (2013.01); *B65D 43/0208* (2013.01); *B65D 43/0212* (2013.01); *B65D 43/161* (2013.01); *B65D 47/0833* (2013.01); *B65D 47/0847* (2013.01); *B65D 47/0876* (2013.01); *B65D 83/0805* (2013.01); *B65D 83/0894* (2013.01); *B65D 2543/00101* (2013.01); *B65D 2543/00296* (2013.01); *B65D 2543/00379* (2013.01)

(58) Field of Classification Search

CPC . A47K 10/421; B65D 43/161; B65D 83/0805
USPC ..... 221/41, 45, 47, 55, 61–63
See application file for complete search history.

(56) References Cited

U.S. PATENT DOCUMENTS

| | | | | |
|---|---|---|---|---|
| 3,576,243 | A * | 4/1971 | Trunick | 221/63 |
| 4,986,440 | A * | 1/1991 | Windorski | B65D 83/0805 221/45 |
| 4,993,590 | A * | 2/1991 | Windorski | B42D 5/005 221/45 |

(Continued)

FOREIGN PATENT DOCUMENTS

| | | |
|---|---|---|
| EP | 0 744 357 A1 | 11/1996 |
| EP | 1 002 746 A1 | 5/2000 |

(Continued)

OTHER PUBLICATIONS

PCT International Search Report, dated Dec. 21, 2011, 9 pages.

(Continued)

*Primary Examiner* — Michael K Collins
(74) *Attorney, Agent, or Firm* — Brian M. Bolam; Abbey A. Lopez

(57) ABSTRACT

A wipes container designed for one-handed use. The wipes container may have a three-dimensional orifice to facilitate access to wipes stored therein. The wipes container may have additional convenience features, including an ergonomic opening button, gripping feet, and a size ratio consistent with moisture retention and one-handed operation. Methods and structures for communicating the proper use of the ergonomic features of the container are also provided.

19 Claims, 9 Drawing Sheets

(51) Int. Cl.
*B65D 47/08* (2006.01)
*B65D 83/08* (2006.01)

(56) References Cited

U.S. PATENT DOCUMENTS

| | | | | |
|---|---|---|---|---|
| 5,542,567 | A | 8/1996 | Julius | |
| 5,927,488 | A * | 7/1999 | Gray | 206/237 |
| 6,032,825 | A * | 3/2000 | Guthrie | 220/731 |
| D436,273 | S * | 1/2001 | Lange | D6/519 |
| 6,550,634 | B1 | 4/2003 | Alegre De Miquel et al. | |
| 6,902,077 | B1 | 6/2005 | Tack | |
| 7,134,572 | B2 | 11/2006 | Morin | |
| 7,216,775 | B2 | 5/2007 | Evans et al. | |
| D594,754 | S * | 6/2009 | Dretzka | D6/518 |
| 7,681,725 | B2 * | 3/2010 | Mueller et al. | 206/210 |
| 8,245,876 | B2 * | 8/2012 | Gehring et al. | 221/41 |
| 8,403,167 | B2 * | 3/2013 | Damaghi et al. | 220/254.3 |
| 2004/0164085 | A1 * | 8/2004 | Kitching | A47K 10/3827 221/45 |
| 2005/0087543 | A1 | 4/2005 | Smith | |
| 2005/0211716 | A1 | 9/2005 | Decker et al. | |
| 2005/0263534 | A1 | 12/2005 | Wu et al. | |
| 2007/0000936 | A1 | 1/2007 | Wu et al. | |
| 2007/0017015 | A1 * | 1/2007 | Finell | A47K 11/06 4/483 |
| 2007/0235466 | A1 * | 10/2007 | Fulscher et al. | 221/33 |
| 2009/0050504 | A1 * | 2/2009 | Stechschulte | B65D 47/0871 206/459.5 |
| 2009/0120816 | A1 | 5/2009 | Ruman et al. | |
| 2011/0011767 | A1 * | 1/2011 | Gehring et al. | 206/581 |

FOREIGN PATENT DOCUMENTS

| | | | |
|---|---|---|---|
| EP | 1 268 308 | B1 | 1/2007 |
| WO | WO 2005/112556 | A2 | 12/2005 |

OTHER PUBLICATIONS

U.S. Appl. No. 12/503,460, filed Jul. 15, 2009, Debra Gay Gehring.

* cited by examiner

WET WIPES CONTAINER

CROSS REFERENCE TO RELATED APPLICATION

This application claims the benefit of U.S. Provisional Application Nos. 61/386,206, filed on Sep. 24, 2010, which are incorporated herein by reference.

FIELD OF THE INVENTION

A container for storing and dispensing wipes is disclosed. The wipes container may comprise features such as an orifice, feet, button, texture, or combination of features that facilitate one-handed carry and use of the container.

BACKGROUND OF THE INVENTION

Wet wipes are known in the art as an implement for applying, removing, or simultaneously applying and removing substances to a surface. For example, wipes may be used to apply emollients and remove exudates from the skin when changing a diaper. Such wipes are generally provided in a package, which may be a soft-sided bag or envelope, or a hard-sided tub or box. A hard-sided tub or box may provide a convenient and aesthetically pleasing storage solution for regular use. A soft-sided bag or envelope may be used to store refill packages for a hard-sided tub or box. A soft-sided bag or envelope may also be used as a travel or convenience pack for irregular use. For example, a soft-sided bag may be kept in a diaper bag or vehicle for use when away from home.

A tub or box may include an orifice for "pop up" dispensing. Wipes inside the tub may be separate, individual wipes which are stacked or rolled in an interleaved configuration, or the wipes may be joined at perforation lines. The tub orifice may be designed to hold a portion of a wipe in an easily accessible position, and to separate the wipe from the next wipe in the stack or roll, such that as a wipe is removed from the orifice, a single wipe "pops up" to take its place in the easily accessible position.

Two common modes of failure of a pop up dispenser are daisy-chaining and fall back. Daisy-chaining occurs when wipes are not separated as they are pulled through the orifice, so that two or more wipes are dispensed when only a single wipe was desired. Fall back occurs when a wipe is not fully engaged in the orifice as the wipe ahead of it is removed, such that the "new" wipe does not remain in an easily accessible position, but falls back into the container. These failure modes are at least partially related to properties of the wipes—such as the force required to separate two adjoining wipes. However, the design of the dispenser can reduce or exacerbate the rate and degree of these failures.

These failure modes may be problematic for the end user, in particular when the wipes container is being operated with one hand. A user may need to access a wipe with one hand, for example, when trying to change the diaper of an active or fussy child. In such a situation, a caregiver may need one hand to secure and/or distract the child, while using the other hand to accomplish the diaper change, including opening the soiled diaper, accessing a wipe, cleaning the child, disposing of the soiled wipe and diaper, and applying a fresh diaper. Indeed, even before beginning to change a diaper, a caregiver may need one arm and hand to hold a child, while collecting supplies for a diaper change with the other hand. Of course, one-handed operation of a wipes container may be convenient even where it is not necessary.

Wipes tubs may be designed with attention to daisy-chaining and fall back, and particularly to mechanisms for recapturing a wipe after it has fallen back into the container. Tub designs may also address the need to retain moisture in wet wipes. There remains a need for a holistic tub design that provides convenient, one-handed operation from the time diaper change supplies are collected to the time the container is closed and/or put away.

SUMMARY OF THE INVENTION

A container may comprise a body having a height. The container may have a major lid disposed above the body. The major lid may have an orifice opening into the body. The orifice may be defined by convex sidewalls. The sidewalls may slope inward from a top surface of the major lid to a point beneath the lower surface of the major lid. The container may have a minor lid connected to the major lid. The minor lid may be configured so that it can be opened and closed independently of the major lid. The minor lid may be sized and positioned to close the orifice of the major lid when the minor lid is in a closed position. The orifice may be free of obstructions between the sidewalls.

The orifice may have a depth between 3 and 15 mm from the top surface of the major lid. The orifice may be round in an X-Y plane. The orifice may be an ellipse in the X-Y plane. The orifice may have a length of at least 3 cm. The orifice may have a width of at least 2 cm. The minor lid may comprise a latch. The major lid may comprise a button. The button may have a fitment for the latch of the minor lid. The button and the latch may be configured such that the latch and the fitment can be engaged to hold the minor lid in a closed position. The button and the latch may be configured such that pressing the button releases the minor lid to an open position. The button may have a length of at least two finger widths. The button may have a texture feature.

The container may comprise a plurality of wipes. The wipes may be disposed inside the body of the container. The plurality of wipes may have a collective height. The height of the body less the collective height of the plurality of wipes may be less than the depth of the orifice. The height of the body may be less than a length of a hand. The height of the body may be at least 2.5 cm less than a length of a hand.

The sides of the orifice may comprise upward-facing protrusions. The protrusions may not be visible when viewing the orifice from the top surface of the major lid. The body may have a lower surface comprising one or more feet. The feet may be rounded. The container may have four feet. One foot may be disposed proximate each of four corners of the lower surface of the body. The orifice may have a texture. The body may have a width and a length. The ratio of width to length to height of the body may be between 2.2:1.45:1 inch and 2.42:1.58:1 inch.

DETAILED DESCRIPTION OF THE INVENTION

Figure 1:
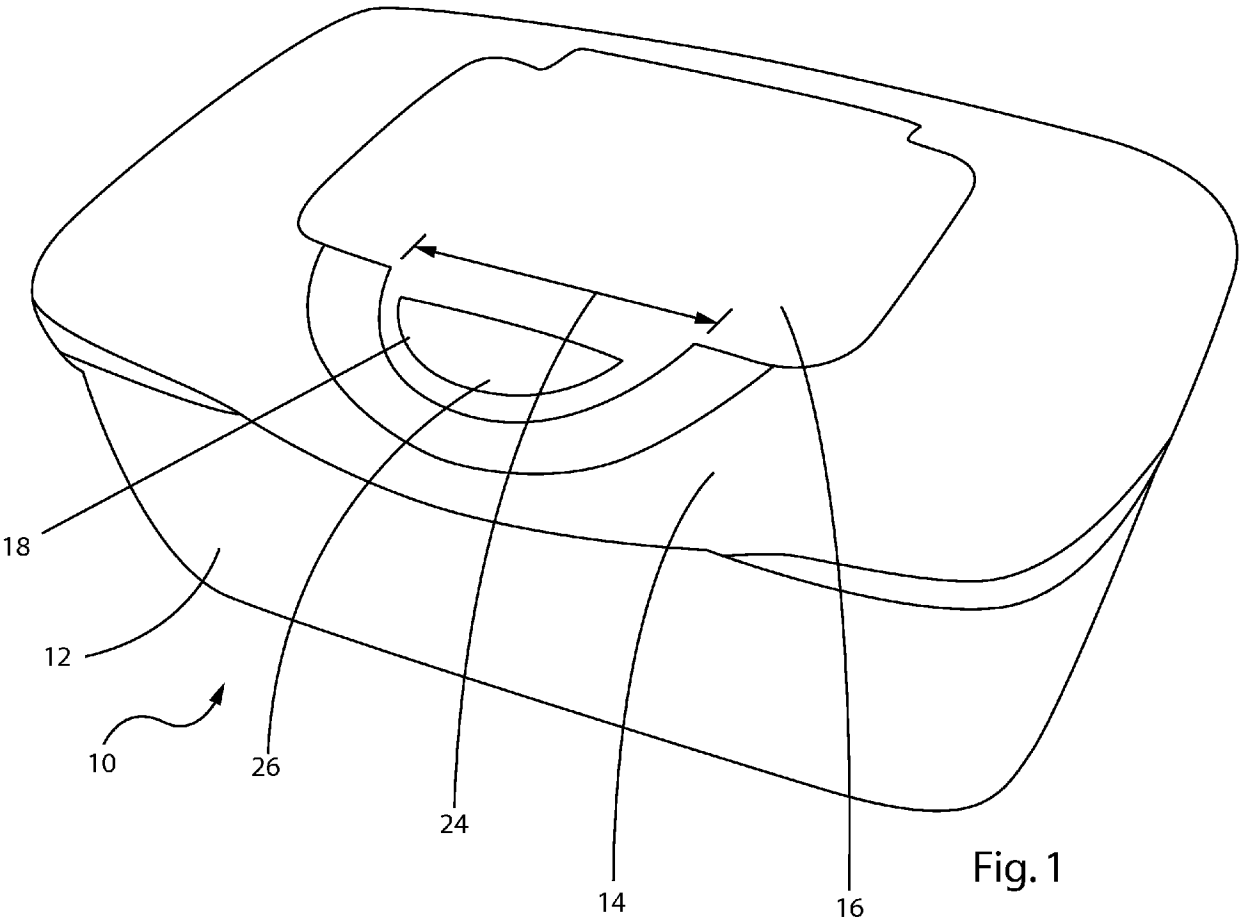
FIG. 1 is a perspective view of an exemplary container.
Figure 2:
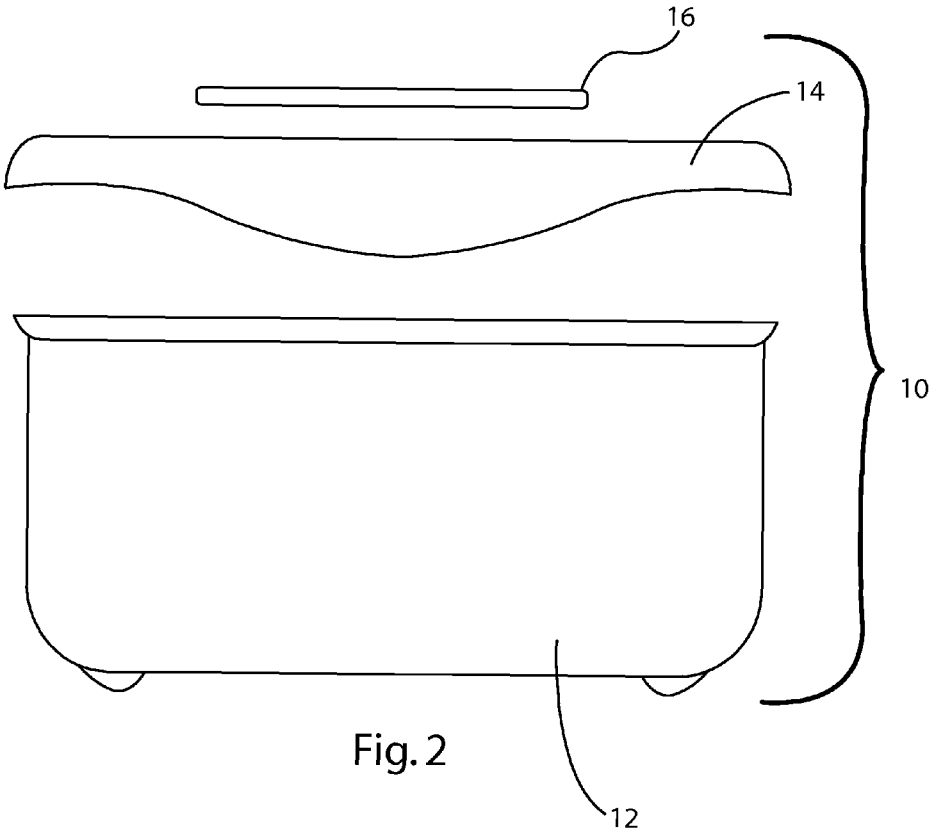
FIG. 2 is an expanded view of an exemplary container.

As used herein, "round" refers to an object or aspect of an object lacking angular corners. The edges or corners of a round object or aspect of an object may have a fillet or a radius (also called a round), or the edges themselves may be round. A round object may be, but is not necessarily, arcuate, circular, or spherical.

In some aspects, the invention relates to a container for wet wipes. The container may comprise one or more features which facilitate one-handed use of the container. For example, the container may have an orifice configured to reduce dispensing errors, so that wipes do not have to be put back into the container (as after a daisy-chain error) or retrieved from the body of the container (as after a fall-back error). The container may have an orifice configured to make it easier to correct dispensing error that do occur. The container may have features which facilitate opening, closing, or using the container, for example, by providing one or more cues for the proper use of the container, or by having proportions which make the container stable on a flat surface as wipes are removed from the container.

FIGS. 1-4 show an exemplary container 10, having body 12, major lid 14, and minor lid 16. Major lid 14 may be disposed generally above body 12 and may have orifice 20 opening into body 12. To help reduce the evaporation of liquid and/or volatile compounds, such as perfumes, from wipes stored within container 10, the interface between body 12 and major lid 14 may include one or more features such as a seal, gasket, press fit, or other means for preventing moisture transfer across the interface. A seal or gasket may be a separate piece fit to body 12, major lid 14, or both body 12 and major lid 14, or the seal or gasket may be part of the construction of body 12, major lid 14, or the interface between them. For example, major lid 14 may include one or more integral lips which extend interiorly or exteriorly below the top edge of body 12 when major lid 14 is fit to body 12, such that the lip "seals" the interface and reduces the air and moisture exchange at the interface. Some exemplary structures for reducing evaporation from a wipes container are described, for example, in U.S. Pat. No. 6,902,077 to Tack, et al. Major lid 14 may be detachable entirely from body 12, or may have a joint that allows major lid 14 to be lifted away from body 12 along an axis defined by the joint. For example, major lid 14 may be rotated away from body 12 along an axis roughly parallel to one of the longer edges of the approximately rectangular container 10 shown in FIG. 1. Major lid 14 might also be rotated away from body 12 along a vertical axis, particularly, but not exclusively, if container 10 has a circular or elliptical footprint. This allows a user to quickly and easily replace a stack or roll of wipes within body 12 as the supply of wipes is depleted.

Minor lid 16 may be attached to major lid 14, body 12, or both major lid 14 and body 12. Minor lid 16 may be detachable from major lid 14 or body 12 or both, or may have a joint that allows minor lid 16 to be lifted away from major lid 14 or body 12 or both along an axis defined by the joint. Minor lid 16 might also be rotated away from major lid 14 or body 12 or both along a vertical axis. Minor lid 16, when rotated up or away from major lid 14 or body 12 or both, provides access to orifice 20. Minor lid 16 may have a joint or rotational axis configured such that minor lid 16 can be moved independently of major lid 14. In such an embodiment, minor lid 16 can be opened to access orifice 20 without opening major lid 14. Where orifice 20 is smaller in size than container 10, the ability to open minor lid 16 without opening major lid 14 may help prevent moisture loss while accessing wipes.

Figure 5A:
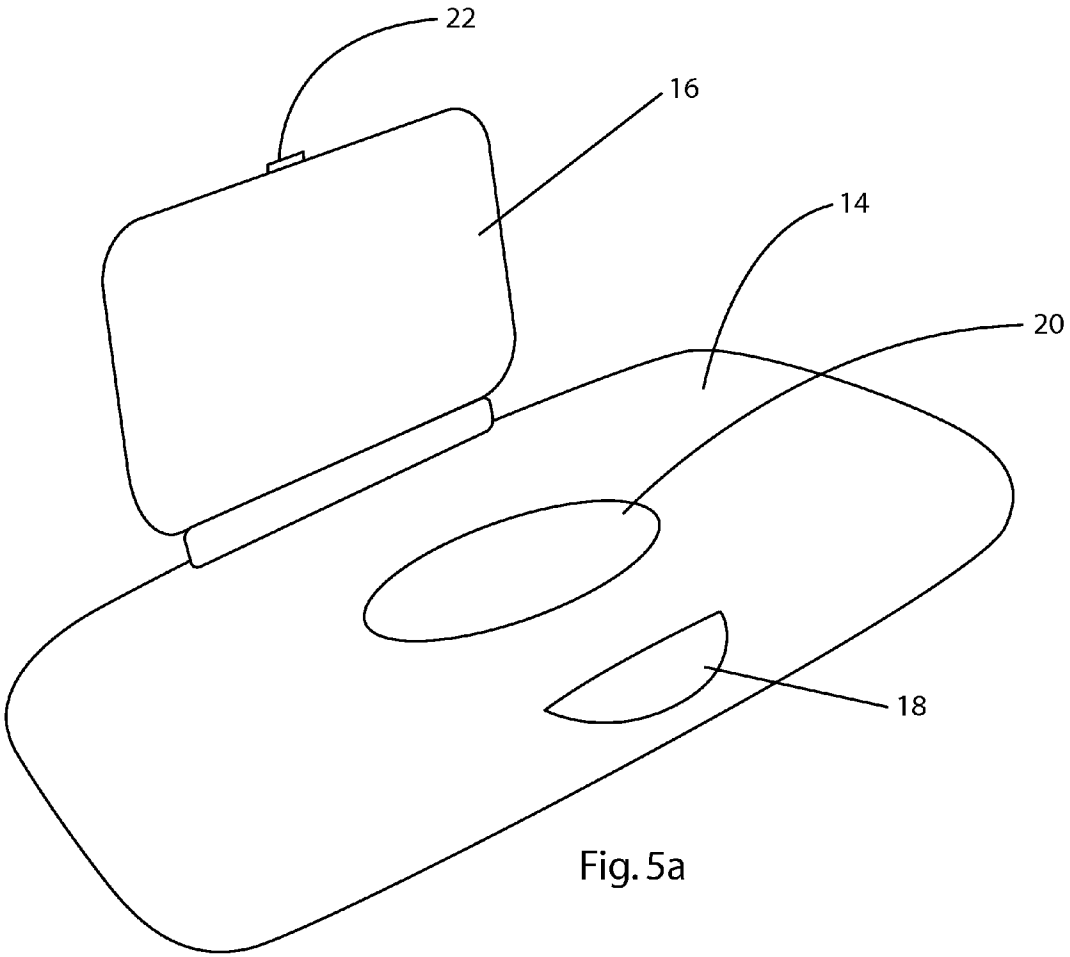
FIG. 5A is a perspective view of an exemplary minor lid and major lid.
Figure 5B:
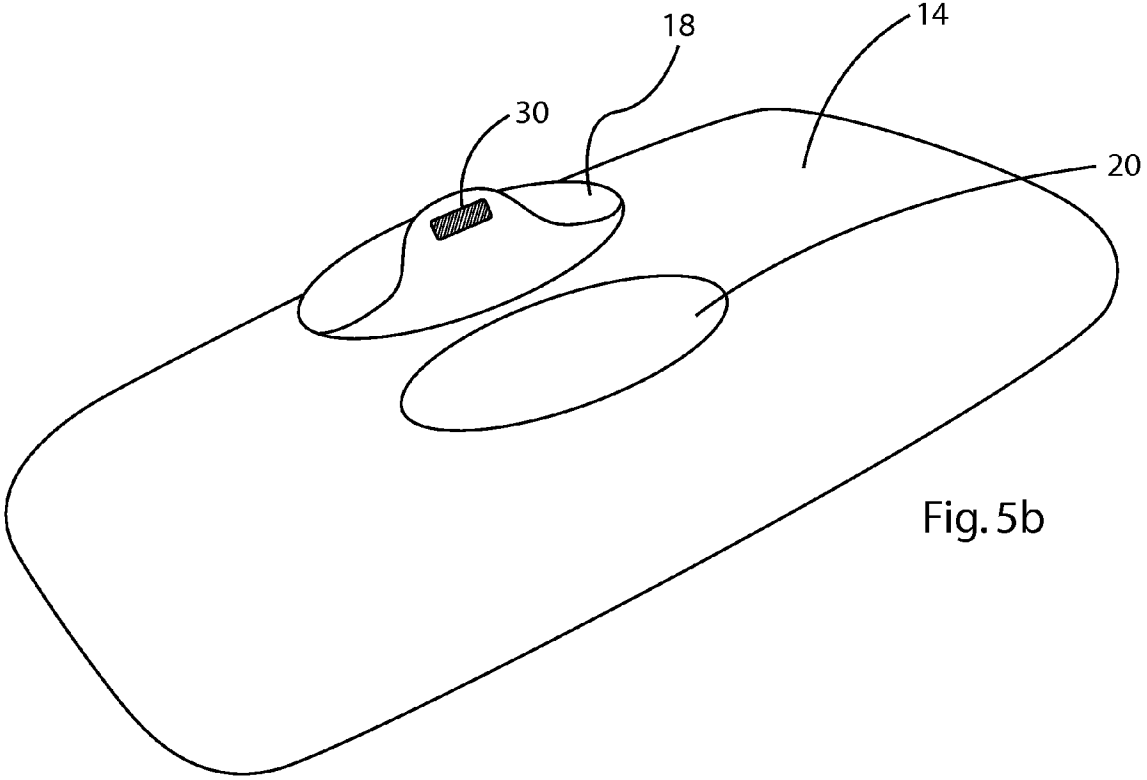
FIG. 5B is a perspective view of an exemplary major lid.

The interface between minor lid 16 and major lid 14 may have features similar to the interface between major lid 14 and body 12, in that it may have gaskets, seals, press fits, or other features to reduce moisture loss at the interface. The interface between minor lid 16 and major lid 14 may include the same moisture-retention feature or features as the interface between major lid 14 and body 12, or a different moisture-retention feature or features. As shown in FIGS. 5A and 5B, minor lid 16 may have latch 22, which is secured by catch 30 or, in some embodiments, an edge protruding from button 18, when minor lid 16 is closed. Thus, catch 30 or button 18 may hold minor lid 16 in a closed position when not in use. When button 18 is pressed generally downward, the change in the position of catch 30 and/or button 18 releases latch 22, and minor lid 16 may open or be freed to open. For example, minor lid 16 may have a passive joint which permits but does not encourage movement, or minor lid 16 may have an active or tensioned joint which causes minor lid 16 to "spring" open when button 18 is depressed. To facilitate one-handed operation, button 18 may have a length 24 of at least two finger widths, such that the button is easy to feel without looking at container 10, and does not require precise locating to operate. That is, button 18 may have a length of approximately 3 cm or greater, to accommodate two fingers on the button. A longer length may, of course, better accommodate larger fingers and may accommodate more than two fingers. Button 18 may further have texture feature 26, which allows a user to verify that he or she has a finger on button 18 without looking at container 10.

Texture feature 26 is distinguishable from the inherent texture of the surface of container 10 and/or button 18. Texture feature 26 may be distinguishable because it is a different texture than the texture of the remainder of button 18. For example, button 18 may generally have a matte finish and texture feature 26 may have a satin finish perceived as smoother or slicker than the matte finish of button 18. Texture feature 26 may be distinguishable because of more pronounced differences in the finish of the surface. For example, texture feature 26 may have bumps or protrusions which are noticeably different to the touch than the remainder of button 18. In some embodiments, texture feature 26 is distinguished because of distinct patterns of raised and/or recessed material, such as engraved lines, which are perceptible to the touch as noticeable discontinuities in the surface of button 18. Texture feature 26, if present, may be sufficiently different from the remainder of button 18 that it can be perceived by touch without looking at container 10 or button 18.

Figure 3:
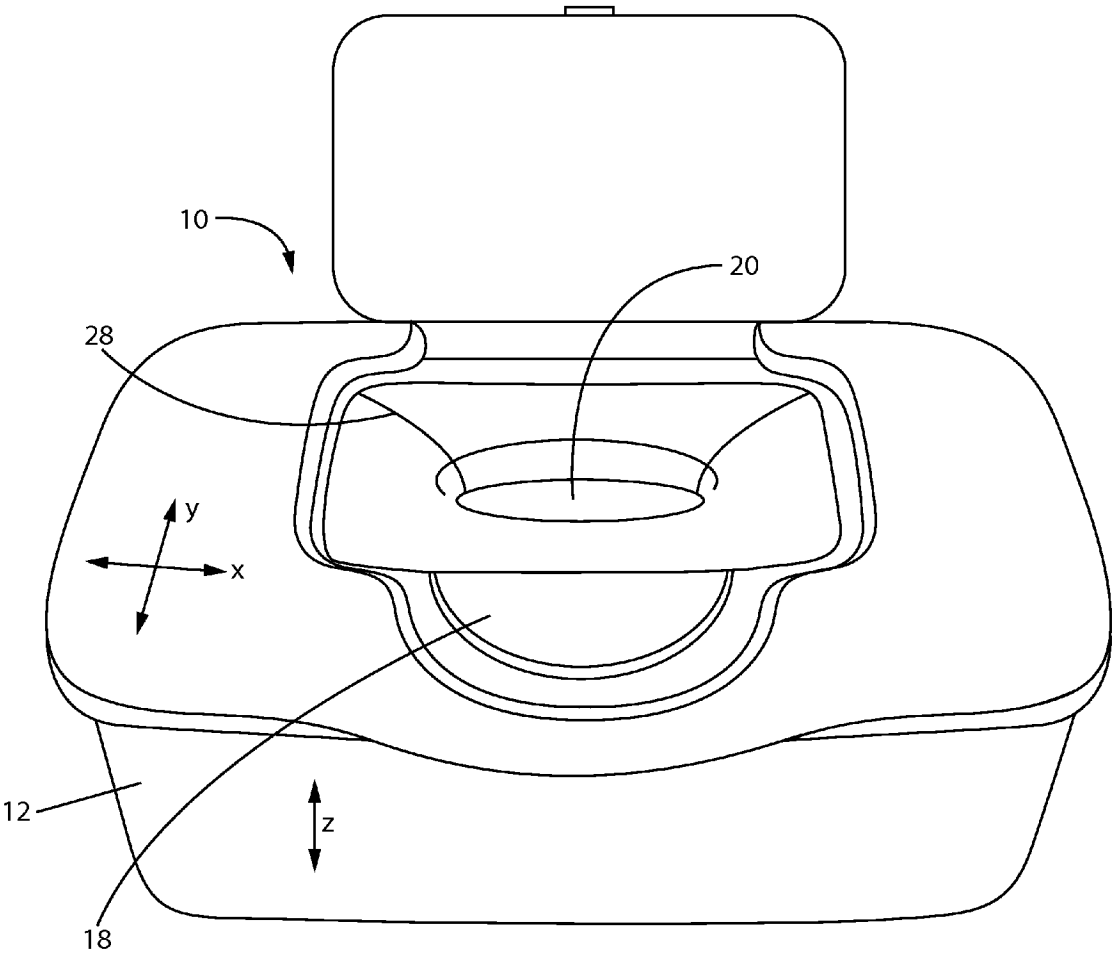
FIG. 3 is a perspective view of an exemplary orifice.
Figure 4:
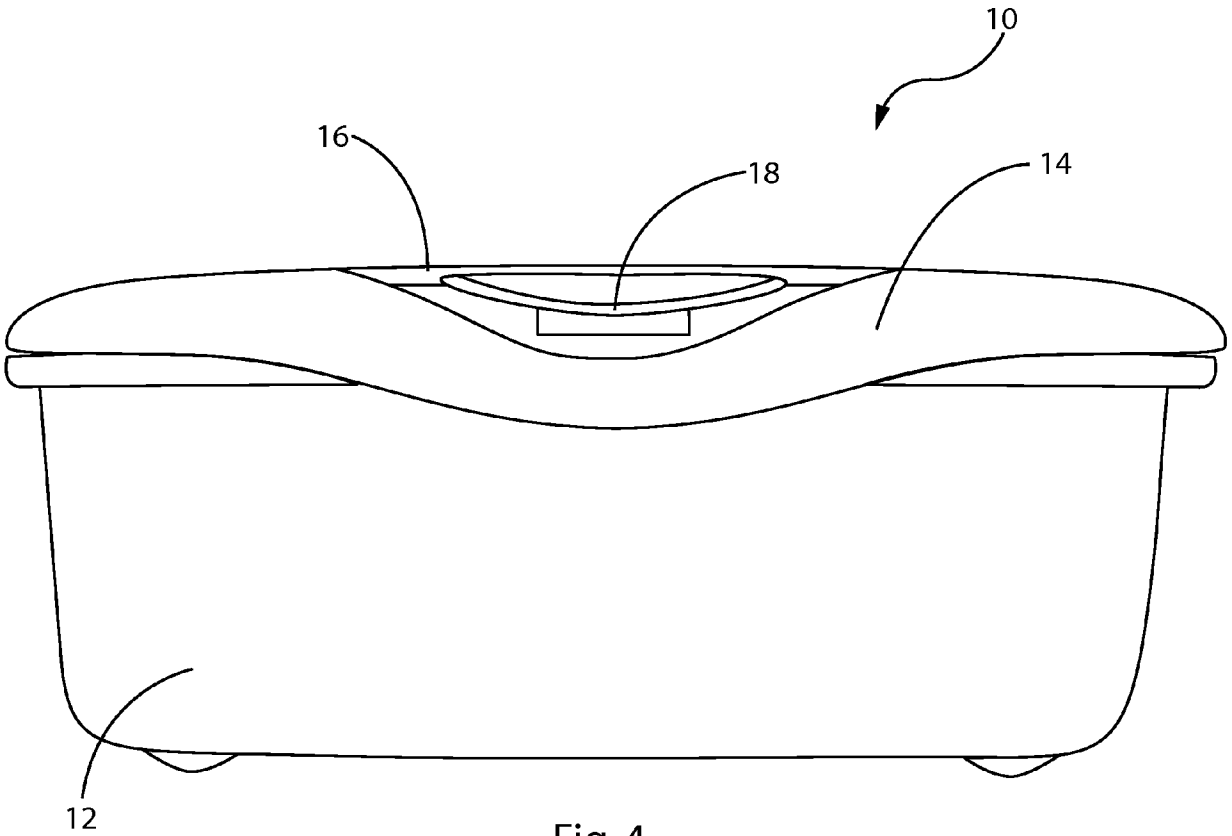
FIG. 4 is a side view of an exemplary container.

As shown in FIG. 3, orifice 20 may be three-dimensional. Orifice 20 may have sidewalls 28, which slope inward and downward from the upper surface of major lid 14, extending below the inner surface of major lid 14. In other words, orifice 20 may have a height or depth that is greater than the height or depth of major lid 14. Thus, orifice 20 may have the general shape of a funnel Sidewalls 28 may be convex, convexo-concave, or convexo-convex. That is, sidewalls 28 may be rounded in, toward the center of orifice 20, as shown in FIG. 3. Sidewalls 28 may be of varying thickness, such that the underside of sidewalls 28 (that is, the side of sidewalls 28 facing the interior of container 10) are concave, or sidewalls 28 may be of substantially uniform thickness, such that the underside of sidewalls 28 are flat or substantially straight-edged. In some embodiments, the underside of sidewalls 28 are convex, such that sidewalls 28 bulge outward from both the underside and the topside of sidewalls 28. It should be understood that sidewalls 28 are referred to in the plural, however, in some embodiments, as shown in FIG. 3, there may be one continuous sidewall 28. For example, orifice 20 may be rounded, and sidewalls 28 may be uninterrupted by seams, joints, corners, or the like, such that there is no clear demarcation between two or more sidewalls 28. In other embodiments, there may be two or more distinct sidewalls 28.

Orifice 20 may be unobstructed between sidewalls 28. That is, there may be no film, barrier, or other material between sidewalls 28 such that orifice 20 is entirely open. In some embodiments, a film, barrier, or other material may be applied over, under, or within orifice 20 as a temporary obstruction. A temporary obstruction may be useful, for example, in preserving wipe moisture during shipping and storage prior to use, if the container is shipped with wet wipes inside. During use, orifice 20 may be free of obstructions. For example, a temporary obstruction, if present, may be removed prior to use. Such removal may be manual, e.g., effected intentionally by the user, as by peeling a film barrier away from orifice 20, or automated, e.g., a temporary obstruction may be connected to minor lid 16 such that upon opening minor lid 16, the temporary obstruction is removed from orifice 20.

Embodiments wherein orifice 20 is unobstructed between sidewalls 28 may facilitate one-handed operation. For example, it may be easier to correct a daisy-chain (e.g., to tuck a wipe back into orifice 20) or fall back (e.g., to reach into the interior of container 10) using only one hand if orifice 20 is unobstructed. More specifically, it may be easier to correct a daisy-chain or fall back using only one hand, without lifting or rocking container 10, if orifice 20 is unobstructed. Dispensing wipes from orifice 20 may also be smoother if orifice 20 is unobstructed. For example, the force necessary to remove a wipe from orifice 20 may be lower and/or more uniform as the wipe is pulled through orifice 20 if orifice 20 is unobstructed. In contrast, some devices for reducing fall back have used very narrow or intentionally obstructed orifices to increase the frictional engagement of each wipe with the orifice. However, these high-friction orifices may prevent a user from removing a wipe from the container with only one hand. For example, to operate a high-friction device, it may be necessary to hold the container with one hand, and pull a wipe with the other hand. An unobstructed orifice 20 may make it easier to operate container 10 with only one hand, relative to high-friction devices.

Orifice 20 is shown as an ellipse in the X-Y plane, however, the shape of the top surface of orifice 20 may be circular, or rectangular, or any other shape, provided that the upside of sidewalls 28 is generally convex to provide a funnel shape. For example, orifice 20 may be shaped like a star, a rectangle, an animal, a flower, or any other shape. In the event of a fall back, the depth of orifice 20 may increase the likelihood that the wipe will not fall completely back out of the orifice, thus making it easier to retrieve the wipe. Sidewalls 28 may also be rounded, even if the shape of the top surface of orifice 20 is not generally rounded (e.g., star-shaped, rectangular, etc.). If a wipe does fall back entirely out of the orifice, the rounded sidewalls and funnel shape of orifice 20 may make it more comfortable to reach into body 12 of container 10 to retrieve the wipe. Orifice 20 may have a length in the X-direction of at least 3 cm, to accommodate at least two adult fingers if it becomes necessary to reach through orifice 20 to grasp a wipe. Orifice 20 may have a width in the Y-direction of at least 2 cm. If the shape of orifice 20 is irregular, these dimensions are measured at the shortest or smallest distance between the sidewalls of orifice 20. At least one of the length or width of orifice 20 may be less than the corresponding width or length of a wipe product intended for use with container 10. If both the length and width of orifice 20 are larger than the wipe product intended for use with container 10, orifice 20 may not engage the wipe. In some embodiments, orifice 20 may have a length in the X-direction of less than 14 cm, or a width in the Y-direction of less than 7 cm. Larger orifice dimensions may permit undesirable rates and/or amounts of moisture loss, for example, if container 10 does not have other moisture retention features.

Figure 8:
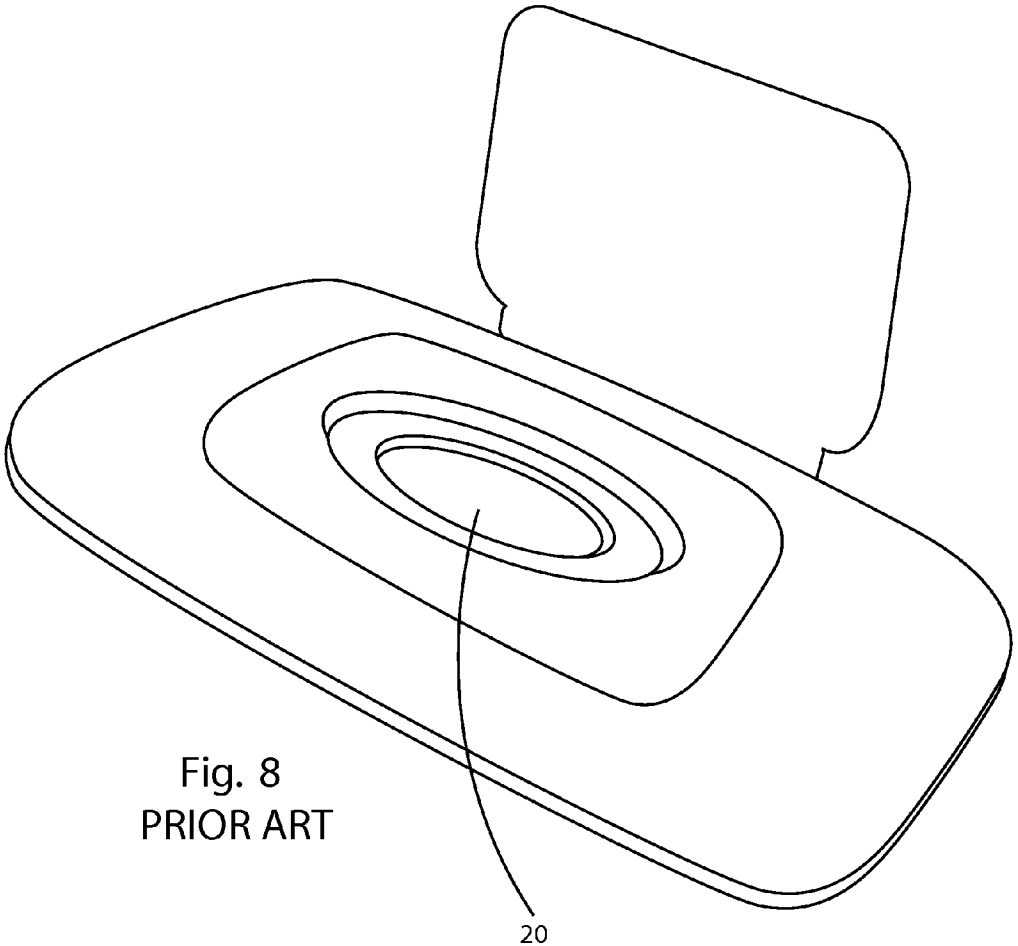
Fig. 8 PRIOR ART
FIG. 8 is a perspective view of an orifice of a prior art container.

In some embodiments, the shape of orifice 20 in the X-Y plane and the surface configuration of sidewalls 28 may be adjusted to modify the interaction of orifice 20 with a wipe being dispensed through orifice 20. For example, an orifice 20 having an elliptical shape in the X-Y plane and convexo-concave sidewalls 28, as shown in FIG. 3, may be more efficient in preventing wipe dispensing "errors," such as daisy-chaining or fall back, than an orifice 20 having an elliptical shape in the X-Y plane and short, flat sidewalls 28, as shown in FIG. 8. Without wishing to be bound by theory, it is believed that a wipe which encounters a first, lower edge of an orifice 20 having a depth in the Z-direction greater than the thickness of major lid 14, and is then pulled across a smooth surface may separate more smoothly and/or more consistently from the next wipe in, for example, an interleaved stack. The depth of orifice 20 may increase the surface area of interaction between the wipe and the orifice 20, which may facilitate separation of distinct wipes and reduce the likelihood of fall back. A concave upper surface of sidewalls 28 may increase the surface area of interaction between the wipe and the orifice 20, which may facilitate separation of distinct wipes and reduce the likelihood of fall back. Combinations of these factors—e.g., depth and roundedness of orifice 20—may have additive or even synergistic effects in improving individual wipe dispensing through the orifice.

Figure 6:
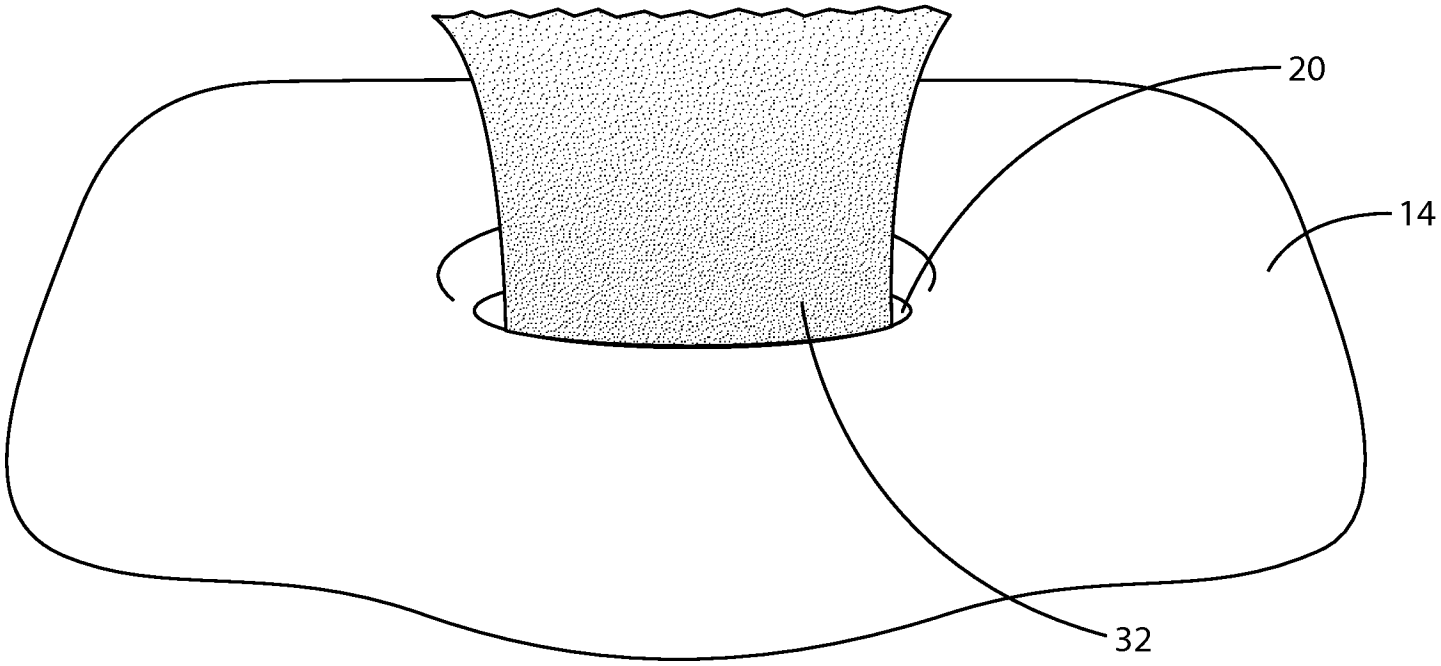
FIG. 6 is an exemplary illustration of a wipe in an orifice.

The shape and depth of orifice 20 may also provide a small headspace in the top of container 10, between body 12 and major lid 14. This headspace is somewhat isolated from orifice 20, and may help prevent the loss of volatile compounds, such as perfumes, and moisture when minor lid 16 is opened and major lid 14 remains closed. In addition, the depth of orifice 20 provides space for the next pop up wipe to reside when minor lid 16 is closed, as shown in FIG. 6. In contrast, a shallow orifice 20 may require pressing a wipe against the top surface of major lid 14 in order to close minor lid 16. This may make it difficult to close minor lid 16, particularly, but not exclusively, with one hand. This may also increase the likelihood that at least part of the wipe will be outside container 10 when minor lid 16 is closed. If part of the wipe is exposed, that wipe or the exposed portion of that wipe may dry out prior to use. Further, if the wipe protruding from minor lid 16 interferes with a seal or gasket designed to retain moisture in container 10, additional wipes may dry out, wholly or partially, prior to use.

In embodiments where orifice 20 has a depth, it is possible to further adapt orifice 20 to prevent fall backs. For example, orifice 20 may be provided with protrusions to "catch" the wipe or provide additional friction forces which would tend to prevent fall backs. Such protrusions may visible, or they may be small enough that they are not visible to a user. The protrusions may be shaped like rods, hooks, loops, or any geometry projecting from the inner walls of orifice 20. For example, the protrusions may be shaped like the hook portion of a hook-and-loop fastener. The protrusions may have rounded ends, so that they are not uncomfortable against the skin if a fall back does occur and the user reaches into body 12 through orifice 20. In lieu of protrusions, the inner walls of orifice 20 may be textured to increase the frictional force encountered by a wipe as it moves against the inner walls. The depth of orifice 20 may be such that the height of body 12 of container 10, less the height of a stack of wipes inside container 10, may be less than the depth of orifice 20. In other words, orifice 20 may not contact the top of the stack of wipes inside container 10.

Container 10 may have a height in the z-direction, including body 12, major lid 14, and minor lid 16, which is less than the length of a typical human hand, for example, less than 15 cm, or less than 10 cm, or even less than 9 cm. Container 10 may have a height in the z-direction which allows a user with a typical hand length to grasp container 10 and at least one diaper or absorbent article with one hand. That is, container 10 may have a height at least 2.5 cm, or at least 3 cm, or at least 4 cm, less than a typical hand length. This may facilitate carrying or moving container 10 and other diaper-changing supplies in advance of or while changing a diaper or other absorbent article. For example, it may be necessary to move changing supplies quickly to place them out of the reach of an infant or young child if a caregiver has underestimated the extent of the child's reach, or if the child has moved from the initial position of the child when the diaper change was started.

Figures 7A, 7B, 7C:
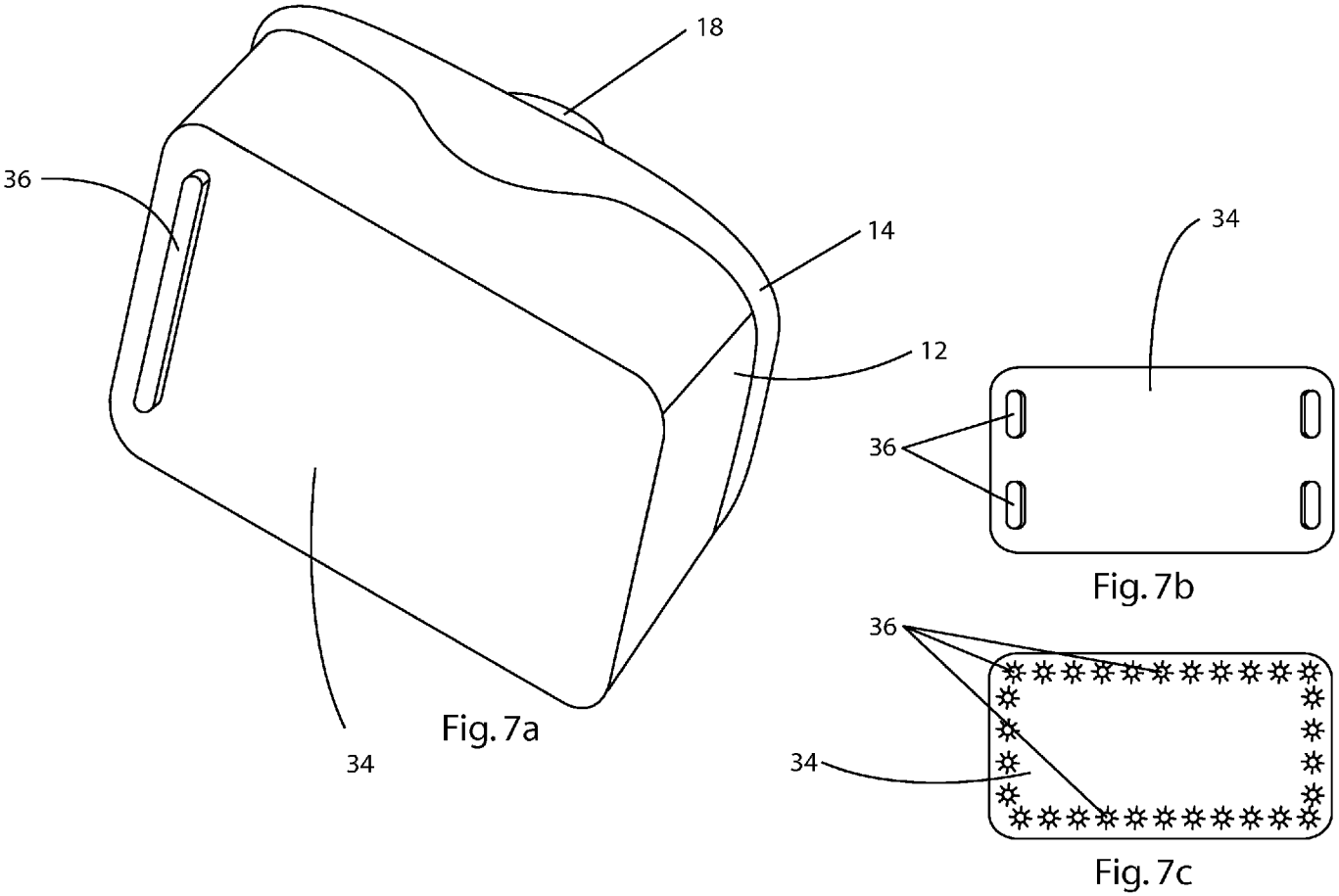
FIG. 7A is a perspective view of the bottom of an exemplary container.
FIG. 7B is a perspective view of the bottom of an alternative container.
FIG. 7C is a perspective view of the bottom of an alternative container.

Container 10 may have a bottom surface 34 comprising one or more feet 36. Feet 36 may help in grasping container 10 with one hand, by providing a finger-hold on at least one surface of the container. As shown in FIG. 7A, bottom surface 34 may have a single foot, shaped generally like a half- or partial-cylinder with rounded, tapered ends. In some embodiments, bottom surface 34 includes two such feet, disposed near opposite ends of bottom surface 34 in the X-direction, such that there is a foot 36 for grasping on either side of container 10. Bottom surface 34 may have two or more smaller feet shaped generally like smaller cylinders, as shown in FIG. 7B, or dots, as shown in FIG. 7C, or any other shape. For example, bottom surface 34 may have four feet, one foot disposed proximate each of the four corners of bottom surface 34 of body 12. Rounded feet may be preferred for aesthetic and/or tactile reasons.

Container 10 may have dimensions which tend to increase its stability. For example, container 10 may have a length in the x-direction, a width in the y-direction, and a height in the z-direction. The ratio of the length to width to height of container 10 may be manipulated to provide a relatively low center of gravity, even when container 10 is empty or nearly empty (e.g., when the wipe supply is completely or partially depleted). A low center of gravity may make it easier to remove wipes from container 10 without the container rocking from side to side or front to back, and may therefore be easier and/or quieter to operate one-handed than a container with a higher center of gravity. The ratio of length to width to height may be between, for example, 2.2:1.45:1 inch and 2.42:1.58:1 inch. The ratio may, for example, be 2.35:1.54:1 inch.

The material used to form the containers described herein or any component thereof is not particularly limited; however, it may be desirable to use material that is impermeable to liquid and/or vapor, for example, when it is contemplated that wet-wipes may be stored in the container. Commonly known wet-wipes, which may comprise more than 10%, 25%, 50%, 75%, or even 95% by weight of water, based on the nominal weight of the wet-wipes, may be stored in the container 10. If a wet-wipe loses too much moisture, it may not provide the desired cleaning benefit, potentially resulting in consumer dissatisfaction with the wet-wipes product. Forming at least part of the container (e.g., one or more walls or portion(s) thereof) from a water and/or vapor impermeable material may at least help reduce the rate and/or amount of moisture lost by the wet-wipes. Exemplary materials include, but are not limited to, thermoplastic resins, including resins of polypropylene, polyethylene, polystyrene, acrylonitryl butadiene styrene (ABS), polyester, polyvinyl chloride, polycarbonate, or combinations thereof. By combinations thereof, it is meant both that the resin used to form container 10 may be a mixture of different kinds of resins; and/or different components of container 10, such as body 12 and minor lid 16, may be formed from different resins or resin mixtures. Container 10 may be formed by any suitable manufacturing process, including, but not limited to, injection molding or thermoforming.

In some embodiments, the material used to form the containers described herein, or any component thereof, may be transparent or translucent. A transparent or translucent container may enable a user of the contents of the container to see the contents, or, in the case of a translucent container, to see a silhouette or general shape or level of the contents. Thus, a transparent or translucent container may assist a user in determining when the supply of wipes or other contents of the container is running low and needs to be replaced. Container 10 or body 12 or both may be uniformly transparent or translucent, or only a portion of container 10 or body 12 or both may be transparent or translucent. For example, a stripe along the side of container 10 or body 12 or both may be transparent or translucent, forming a window for viewing the contents of container 10. Alternately, container 10 or body 12 or both may comprise images, designs, or patterns which are transparent or translucent. For example, the transparent or translucent portions may be in the form of shapes or images which are aesthetically pleasing and also function as a window. A single transparent or translucent shape or image may be present, or two or more transparent or translucent portions may form a repeating or non-repeating pattern or design. Alternatively, container 10 or body 12 or both may transparent or translucent, with images, designs, or patterns which are opaque. Of course, major lid 14 or minor lid 16 or both may comprise transparent or translucent portions or may be entirely transparent or translucent.

Container 10 may comprise any of a number of additional features of varying utility, including, but not limited to, compatibility locks and/or actuators, as described, for example, in U.S. Pat. No. 7,621,401 to de Miguel, et al.; indicia to aid in the selection of a wipes product, as described, for example, in U.S. Pat. No. 7,770,729 to Warren, et al.; or a wipe warming system, as described, for example, in U.S. Patent Application Publication No. 2010/00032443 to Mueller, et al. Container 10 may be adapted to coordinate with a specific wipe product or a specific wipe package. For example, the shape, size, and/or texture of orifice 20 of container 10 may be optimized for a wipe having a specific basis weight, substrate type, lotion load, or lotion type. Container 10 may comprise indicia, including words and/or images, to indicate that container 10 is adapted to coordinate with a specific wipe product. Container 10 may be sold as a kit comprising one or more wipes; one or more packages of refill wipes; instructions for using wipes, including, but not limited to, instructions for refilling wipes in a container or removing wipes from a container; or combinations thereof. Container 10 may be transported, stored, and/or displayed for sale in an overwrap. The overwrap, if present, may contain information to aid in the selection of a wipe product, or information for identifying the container and/or a wipe product within the container. The overwrap, if present, may reduce or prevent the evaporation of moisture from a moisture-containing wipe inside the container.

A method of communicating the proper use of a container may include providing a texture feature 26 on one or more elements of container 10 which are contacted during use. For example, button 18 may comprise a texture feature 26, as described above. In some embodiments, foot or feet 36 may comprise a texture feature 26. If more than one texture feature 26 is present, the texture features 26 may be the same or different. For example, button 18 may comprise a texture feature 26 which is a raised or recessed pattern or image, and foot 36 may comprise a texture feature 26 which is matte, if body 12 is satin, or texture feature 26 on foot 36 may be satin if body 12 is matte. Texture feature(s) 26 may employ images which further communicate the function or position of the component on which texture feature(s) 26 is disposed. For example, texture feature 26 on foot 36 may be shaped like a finger, or hand, or a portion of a finger or hand which is intended to grasp texture feature 26 on foot 36. The images may be directly associated with the intended use. For example, the image may directly resemble a finger or a hand. Alternately, the image may comprise a shape which is complementary to the intended use. For example, texture feature 26 on button 18 may have a curved shape which would "catch" a finger or fingers being moved along the surface of container 10 (as by a caregiver who is trying to open container 10 without looking at it).

Container 10 may comprise packaging, such as an overwrap or a label. The packaging, if present, may include instructions for using container 10. For example, the instructions may draw attention to the features of container 10, if present, for facilitating one-handed operation of container 10. The instructions may describe how to fill or refill container 10 with wipes, or how to determine when the wipe supply inside container 10 is nearly depleted, or both. The instructions may comprise written words, or graphics, marks, images, photographs, or other indicia which communicate how to use container 10 or one or more features of container 10.

EXAMPLES

A tub having an orifice as shown in FIG. 3 and a tub having an orifice as shown in FIG. 8 are each used to dispense 30 stacks of each of three different kinds of wipes. The orifice of FIG. 8 has a depth approximately the depth of the major lid, which in the embodiment tested, is approximately 1 mm. A naked stack is a stack of wipes which is enclosed only by the tub. A film wrapped stack is a stack of wipes which is wrapped in a thin film package having an opening at the top of the stack of roughly the same two-dimensional surface shape and size as the dispensing orifice in the tub. The number of incidents of daisy-chaining and fall back are recorded. The results are summarized in the table below.

| Event | Wipe Type | Tub of FIG. 3 | Tub of FIG. 8 |
|---|---|---|---|
| Daisy-Chaining | Lotion 1, Naked Stack | 1.7 | 5.2 |
| | Lotion 1, Film Wrapped | 1.7 | 4.5 |
| | Lotion 2, Naked Stack | 2.7 | 6.8 |
| Fall Back | Lotion 1, Naked Stack | 2.3 | 13 |
| | Lotion 1, Film Wrapped | 0.2 | 0.1 |
| | Lotion 2, Naked Stack | 2.2 | 3.9 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A wipes container comprising:

a body configured to receive a plurality of wipes;

a major lid disposed above the body and defining an orifice opening into the body, wherein the orifice is formed by a single continuous convex sidewall which continually slopes inward from a top surface of the major lid to a point beneath a lower surface of the major lid to define the shape of the orifice; and a minor lid connected to the major lid and moveable between a first, open position in which the minor lid allows access to the orifice and a second, closed position in which the minor lid covers the orifice;

wherein the minor lid comprises a latch extending outwardly from the minor lid in a direction generally in a plane of the minor lid, wherein the major lid comprises a button, wherein the button defines a fitment configured to receive the latch of the minor lid, wherein the fitment and the latch are configured to hold the minor lid in a closed position when the button is in a non-depressed position, and wherein the fitment and the latch are configured to release the minor lid into an open position when the button is in a depressed position; and wherein the orifice forms an ellipse in an X-Y plane.

2. The container of claim 1, wherein the orifice has a depth between 3 and 15 mm from the top surface of the major lid.

3. The container of claim 1, wherein the orifice has a length of at least 3 cm.

4. The container of claim 1, wherein the orifice has a width of at least 2 cm.

5. The container of claim 1, wherein the button has a length of 3 centimeters or greater.

6. The container of claim 1, wherein the button has a texture feature.

7. The container of claim 1, comprising a plurality of wipes disposed inside the body, wherein the plurality of wipes have a collective height.

8. The container of claim 7, wherein the height of the body less the collective height of the plurality of wipes is less than the depth of the orifice.

9. The container of claim 8, wherein the height of the body is less than 15 centimeters.

10. The container of claim 9, wherein the height of the body is less than 10 centimeters.

11. The container of claim 1, wherein the sides of the orifice comprise upward-facing protrusions.

12. The container of claim 11, wherein the protrusions are not visible when viewing the orifice from the top surface of the major lid.

13. The container of claim 1, wherein the body has a lower surface comprising one or more feet.

14. The container of claim 13, wherein the feet are rounded.

15. The container of claim 14, having four feet, one foot disposed proximate each of four corners of the lower surface of the body.

16. The container of claim 1, wherein the orifice has a texture.

17. The container of claim 1, wherein the body has a width and a length, and the ratio of the width to length to height is between 2.2:1.45:1 inch and 2.42:1.58:1 inch.

18. A wet wipes container comprising:

a body configured to receive a plurality of wet wipes;

a major lid disposed above the body and having an orifice opening into the body, the orifice formed by a single continuous convex sidewall which continually slopes inward from a top surface of the major lid to a point beneath a lower surface of the major lid to define the shape of the orifice; and a minor lid connected to the major lid and moveable between a first, open position in which the minor lid allows access to the orifice and a second, closed position in which the minor lid covers the orifice wherein the orifice forms an ellipse in an X-Y plane;

a button on the major lid and movable between a depressed position and a non-depressed position, wherein the button comprises an arcuate edge and a linear edge.

19. A wet wipes container comprising:

a body configured to receive a plurality of wet wipes;

a major lid disposed above the body and defining an orifice opening into the body, wherein the orifice is formed by a single continuous convex sidewall which continually slopes inward from a top surface of the major lid to a point beneath a lower surface of the major lid to define the shape of the orifice, wherein the major lid comprises a side wall, wherein the side wall comprises a convex portion extending outwardly therefrom, and wherein a portion of the convex portion overlaps the body when the major lid is in a closed position more than the remainder of the side wall overlaps the body; and a minor lid hingeably engaged with the major lid and rotatable between a first, open position in which the minor lid allows access to the orifice and a second, closed position in which the minor lid covers the orifice;

wherein the minor lid comprises a latch extending outwardly from the minor lid, wherein the major lid comprises a button, wherein the button defines a fitment configured to receive the latch of the minor lid, wherein the fitment and the latch are configured to hold the minor lid in a closed position when the button is in a non-depressed position, and wherein the fitment and the latch are configured to release the minor lid into an open position when the button is in a depressed position;

wherein the orifice forms an ellipse in an X-Y plane;

wherein the button comprises an arcuate edge and a linear edge; and wherein the minor lid is generally rectangular.

* * * * *